United States Patent [19]

Genge et al.

[11] 4,032,024

[45] June 28, 1977

[54] APPARATUS FOR DISTRIBUTION OF CHARGE MATERIAL IN SHAFT FURNACES, PARTICULARLY HIGH PRESSURE BLAST FURNACES

[75] Inventors: Ulrich Genge, Duisburg; Manfred Eutenereu, Neukirchen-Vluyn, both of Germany

[73] Assignee: Demag Aktiengesellschaft, Germany

[22] Filed: Nov. 12, 1975

[21] Appl. No.: 631,071

[30] Foreign Application Priority Data

Nov. 26, 1974 Germany ..... 2455767

[52] U.S. Cl. ..... 214/35 R; 193/17; 266/176

[51] Int. Cl.[2] ..... B66C 17/08

[58] Field of Search ..... 214/35 R, 17 C, 17 CB; 193/17; 198/536; 266/176

[56] References Cited

UNITED STATES PATENTS

| | | | |
|---|---|---|---|
| 2,753,056 | 7/1956 | Eastman et al. | 214/35 R |
| 3,814,403 | 6/1974 | Legille | 214/35 R X |
| 3,864,984 | 2/1975 | Legille | 214/35 R X |
| 3,921,831 | 11/1975 | Takahashi et al. | 214/35 R |

*Primary Examiner*—Albert J. Makay
*Attorney, Agent, or Firm*—Mandeville and Schweitzer

[57] ABSTRACT

An apparatus is provided for the even distribution of charge material in shaft furnaces, particularly high pressure blast furnaces. The apparatus includes a stationary hopper with a distributor pipe hinged universally below it. The universal swivel hinge is formed with an annular support swiveling around a first horizontal axis, the distributor pipe being suspended in such annular support to swivel around a second axis at right angles to the first axis.

11 Claims, 3 Drawing Figures

2
1
II
10
7
III
9
8
6
5
4
III
6
11
7
3
1
II

APPARATUS FOR DISTRIBUTION OF CHARGE MATERIAL IN SHAFT FURNACES, PARTICULARLY HIGH PRESSURE BLAST FURNACES

BACKGROUND OF THE INVENTION

The burden fed into a shaft furnace, in order to achieve optimum furnace operation, must be deposited onto the charge surface, depending upon particular conditions, in a speifically arranged manner. Several types of installations have been suggested for this purpose. A charging apparatus for high pressure blast furnaces is disclosed in German Publication No. DAS 2,035,458 where, below the charge hopper, which is centrally located in the furnace hood, a rotating chute is arranged which, simultaneously, rotates and swivels. That is, the angle of discharge towards the charge surface may be varied. The chute is suspended from a swivel sleeve surrounding the charge hopper and is connected with a control lever which meshes with a second and normally synchronous swivel sleeve. In order to alter the chute angle, the second normally synchronous swivel sleeve is angled towards the first swivel sleeve. For this arrangement, there are structural parts exposed in the furnace chamber which carry out rotary movements. Special measures must be taken to protect those parts from the effects of the prevailing dust in the chamber. This is done by supplying a special sealing gas to those chambers in which the rotating parts are positioned.

German Publication No. DOS 2,104,116 discloses effecting distribution of the charge material by means of a universally flexible distributor pipe. The distributor pipe pivots on a transverse axis, and is hinged in an annular support which in turn swivels around a horizontal axis. While the swivel motion of the annular support is caused by a gear, to which at least one of the two journal bearings of the annular support is connected, thereby being out of the furnace chamber, the pivot motion of the distributor pipe housed in the annular support requires intricate mounting. A second annular support is connected to the distributor pipe above its seat in the first annular support, and may be displaced parallel with the swivel axis of the first annular support. By displacing this second annular support, it is possible to adjust the distributor pipe in the annular support within certain limits. By superimposing both movements, the distributor pipe can be aimed at any spot on the charge surface. However, the requirement of a second displaceable annular support involves complicated structure. Furthermore, it is relatively heavy.

DESCRIPTION OF THE INVENTION

The object of the invention is to improve upon the apparatus as previously described in a manner which permits adjustment of the charge distribution pipe, and the annular support, with technically less complicated and less expensive means than those employed in the past. This is solved, according to the invention, by interconnecting the annular support and/or the distributor pipe, and their related exteriorly positioned drives with linkages incorporating non-fixed pivot connections.

Each driving means may consist of a lever movable in a vertical plane and connected to an intermediate part or linkage. The intermediate part is connected at each end through non-fixed pivots to a lever, and an annular support or distributor pipe. This results in a simple but rugged overall construction, which stands up to the great demands of a blast furnace. At the same time, the advantages achieved by using a distributor pipe are maintained. These advantages are that the charge can be directed exactly to the desired area on the charge surface, and that wear caused at the pipe interior by the charge material is distributed over the entire interior pipe surface because of its repeated repositioning. Moreover, because the adjusting movements of the annular support and the distributor pipe are effected by reversible driving elements, the apparatus of the invention can be modified to accommodate many design considerations.

In this connection, levers forming part of the drive may be positioned in the furnace chamber above the admission opening for the distributor pipe because there is sufficient space available within the furnace hood and the movement does not interfere with any of the parts forming the distribution device. Each lever is attached to a horizontal shaft which extends through a sealed passage in the furnace shell, and connected to, preferably, a rotary drive. If only adjustment of the distributor pipe by means of the lever and the intermediate linkage is to be performed, only two sealed gas-tight and dust-proof passages are required in the furnace shell for the mentioned shafts.

The intermediate connecting piece or linkage may consist of a rod attached on both ends by means of Cardan joints. Such joints can be made to accommodate the required stress without constant maintenance. In a modified arrangement, the intermediate linkage, in accordance herewith, may be a flexible element, such as a cable or chain. In that case, the swivel lever may be connected with a cam disc which serves as the bearing surface for the flexible element. Also, the drive element may be a push and pull element permitting merely straight motion and going through the furnace shell in a gas-tight passage. For example, such a drive element may be moved back and forth by means of a reversible piston-cylinder unit located outside the furnace chamber. Here, too, a connecting piece, connected at both ends to movable pivot joints, is arranged between the portion of the drive element which is located within the furnace chamber, and the annular support or distributor pipe.

According to a further embodiment of the invention, the intermediate linkage may consist of a toggle lever arrangement, whereby the one lever leading from the toggle joint to the annular support or distributor pipe has universal joints on both ends, while the other lever, at the end away from the toggle joint, is flexibly hinged in a joint movable in a vertical plane extending radially with respect to the distributor pipe, and through a drag connection is connected to a drive element permitting straight motion.

Regardless of the details of design of the distribution device, it is preferable to arrange the pivot axes of the annular support and the distribution pipe in a common plane. This allows small lateral deflection of the lower ends of the connecting linkages compared to that of the upper ends, when the distributor pipe is moved towards the annular support and the latter is simultaneously moved from its horizontal starting position.

As purely illustrative of apparatus for carrying out the invention, one may note the attached drawings in which the mounting for a high pressure blast furnace distributor pipe is shown, with the pipe mounted below a fixed hopper for the universal positioning of the exit end of the pipe for even distribution of the burden over the charge surface.

Figure 1:
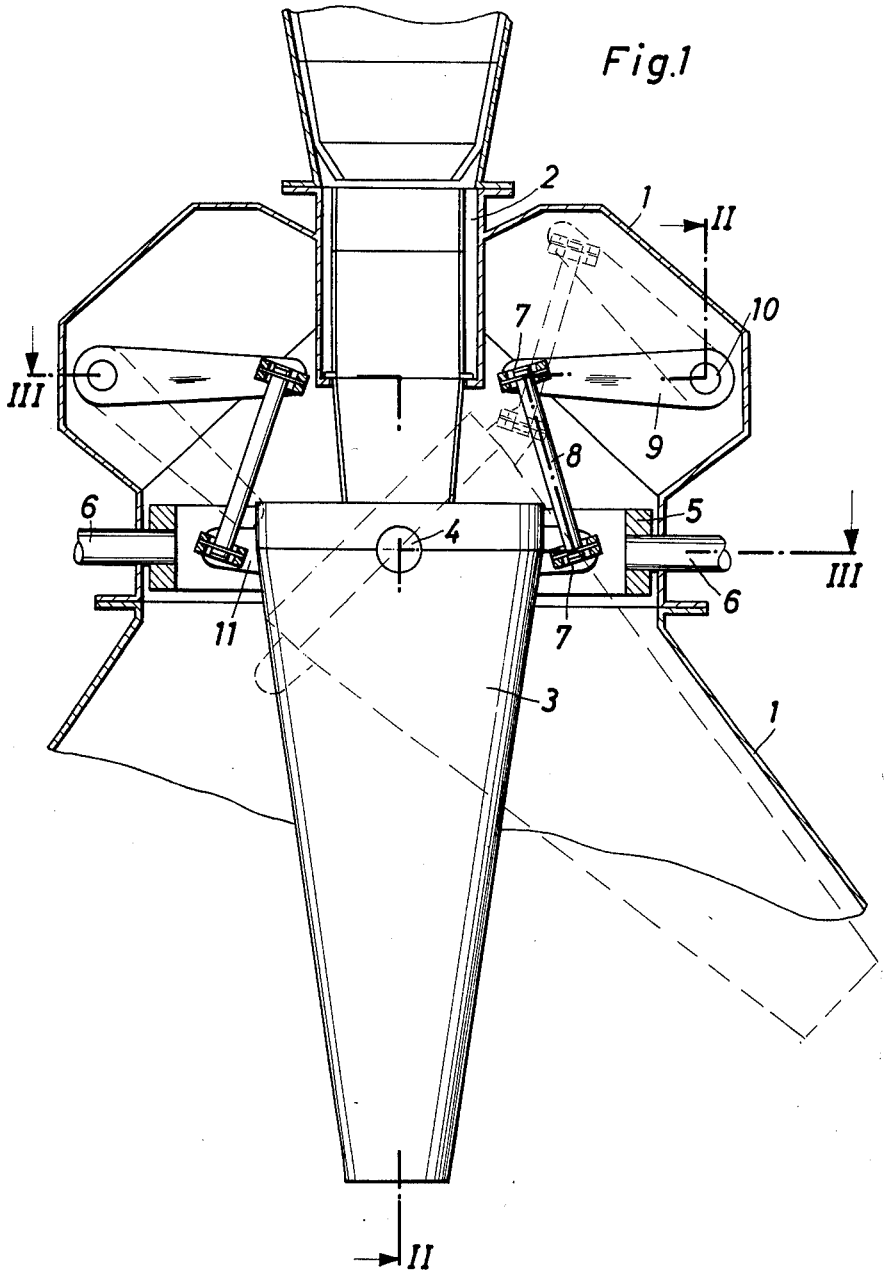
FIG. 1 is a vertical axial section through the upper portion of a blast furnace.

Referring to the drawings, in which like reference numerals refer to like parts throughout the several views thereof, the upper part of a high pressure blast furnace is shown in FIG. 1 with a furnace hood 1, and centrally located stationary feed hopper 2. (The preceding locks and bunkers for the charge material are not shown.) Below feed hopper 2, distributor pipe 3 is positioned and movable universally, so that charge material can be directed to any desired spot on the charge surface.

The upper end of distributor pipe 3 is pivotally mounted on two diametrically positioned journals 4 in annular support 5. Annular support 5 is pivotally mounted in two opposed journals 6 in the furnace hood. The journals for distributor pipe 3 and the annular support 5 are spaced 90° from each other around the furnace. Thus, distributor pipe 3 is housed in Cardan suspension. Journals 6 of annular support 5 where they pass through the furnace shell, are provided with rotary seals, as will be understood, and are connected to a drive (not shown) for effecting rotation thereof. When annular support 5 is pivoted or swivelled on journals 6, distributor pipe 3, being in its vertical starting position moves in a vertical plane, transverse to the axis of journals 6.

In order to pivot distributor pipe 3 in its journal bearings 4 on annular support 5, a pair of the rods 8 are attached at two diametrically opposed locations on pipe 3 by means of non-fixed pivot joints 7. The attachment locations are in a vertical plane extending through opposed annular support journals 6. Tie rods 8 are pivotally connected, again by non-fixed pivot joints 7, at their ends away from distributor pipe 3, on levers 9, which move up and down. The effective length of levers 9 is the same as the distance between Cardan joints 7 disposed on distributor pipe 3 and the pivot axis thereof on opposed journals 4. Levers 9 are connected to horizontal shafts 10, which lead through rotary seals in furnace shell 1, and are connected to a drive (not shown) on the outside of the shell.

Each of non-fixed pivot joints 7 are preferably identical Cardan joints. An example of such Cardan joints is shown in detail in FIG. 2. Between two consoles 11, protruding from the exterior circumference of distributor pipe 3, rings 13 rotates around journal 12. The end of tie rod 8 is attached to the ring 13 by means of bolt 14 which crosses at right angle to the pivot axis of ring 13 formed by journal 12.

The mode of operation is as follows: by combining the pivot motion of the annular support with that of the distributor pipe in the annular support, the lower end of the distributor pipe can be brought into any desired position, thus directing the charge material to any point on the charge surface. The adjustment of distributor pipe 3 on annular support 5 is done by raising or lowering distributor pipe 3 by means of linkages 8 and 9. Due to the non-fixed pivot connection of tie rods 8 at each end, they are completely displaceable. Therefore, the adjustment of distributor pipe 3 is possible in any transverse inclination or angle in relation to annular support 5. While the lower end of distributor pipe 3, when pivoting only the pipe 3 or annular support 5, covers merely a straight path running transverse through the furnace chamber, whereby the two paths cross at right angle, when superimposing both motions, which is achieved by proper control of the drives, the lower end of the distributor pipe will follow a cone-shaped path. Needless to say, the distributor pipe end can be directed towards any point within the circle forming the base of this cone in any sequence desired.

Figure 2:
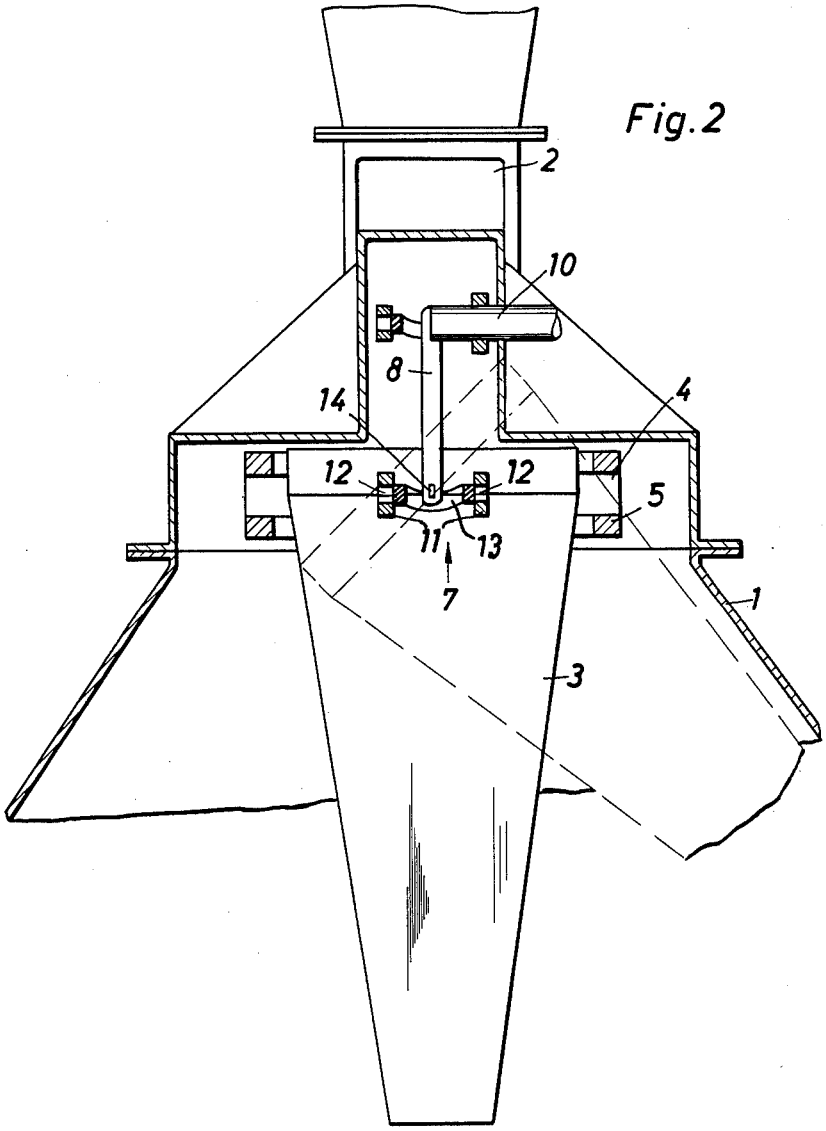
FIG. 2 is a cross section taken along lines II—II of FIG. 1.
Figure 3:
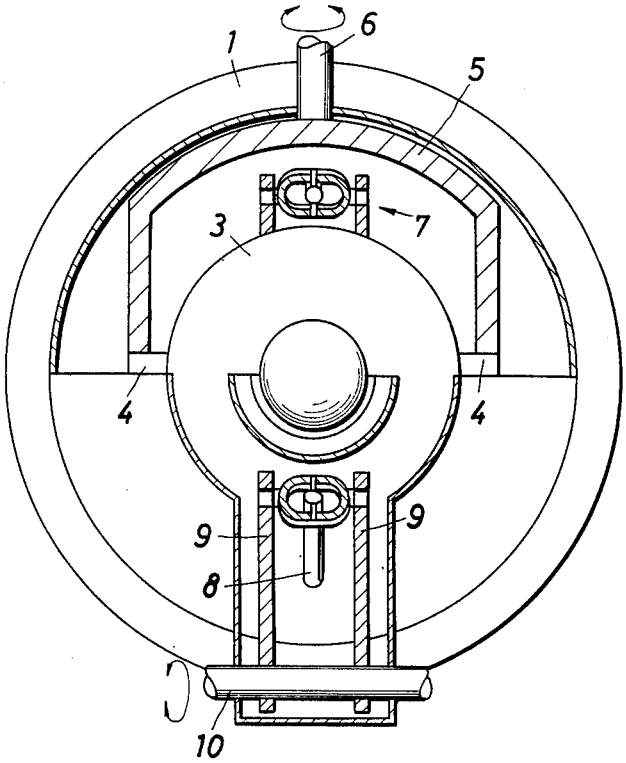
FIG. 3 is a cross section taken along line III—III of FIG. 1.

As indicated in FIGS. 1 and 2, when distributor pipe 3 is in its extreme horizontal position, the lateral deflection of the lower ends of tie rods 8, compared to their upper ends, remain relatively small even during the optimum pivot motions. This is so because of the positioning of the pivot joints 7 in the axis of journals 6 in the extreme vertical position of pipe 7.

As will be understood by practitioners in the art, the adjustment device for the distributor pipe 3, described above, can also be applied to pivot annular support 5. In that arrangement, two additional levers 9 are provided besides the two existing levers 9 and positioned 90° from them. They are connected with annular support 5 via tie rods 8 equipped with Cardan joints at their ends in the same manner.

If desired, tie rods 8 can be arranged to transmit thrust forces. Moreover, flexible elements, such as chains or cables, may be used in lieu of tie rods 8. With this arrangement, Cardan joints would not be used. When utilizing such flexible elements, a cam disc may be placed on shaft 10 instead of swivel lever 9, with the cam serving as a bearing surface for the flexible element. The shape of the cam disc may be chosen so that the momenta occurring at shaft 10 in the various positions of distributor pipe 3 are as favorable as possible. The annular support as well as swivel levers 9 may be supplied with cooling and/or lubricating agents through bore holes in journals 6 and shafts 10, respectively, as is well known.

While the apparatus herein disclosed forms preferred embodiments of this invention, this invention is not limited to those specific embodiments, and changes can be made therein without departing from the scope of the invention, which is defined in the appended claims.

We claim:

1. Apparatus for evenly distributing charge material to shaft furnaces, comprising a. a furnace with a stationary hopper disposed in the top of said furnace;

b. an annular support disposed in said furnace adjacent the bottom of said hopper and arranged to pivot on a first horizontal axis extending through said furnace;

c. a distributor pipe disposed on said support and arranged to pivot in vertical plane on a second horizontal axis on said support;

d. said first and second horizontal axes being perpendicular to each other; characterized by e. reversible drive means positioned outside the wall of said furnace;

f. first means connecting said drive means to said annular support for the pivoting thereof around said first axis;

g. linkage means connecting the circumferential edge of said distributor pipe to said drive means to pivot said pipe around said second horizontal axis;

h. said linkage means including a non-fixed universal connecting said drive means and said distributor pipe.

2. The apparatus of claim 1, further characterized by said linkage means including a. lever means connected to said drive means, said lever means being movable in a vertical plane;

b. a tie rod connecting said lever means and said distributor pipe; and c. said non-fixed universal connections being positioned at each end of said tie rod.

3. The apparatus of claim 2, further characterized by a. said lever means is positioned in said furnace above the upper opening of said distributor pipe.

4. The apparatus of claim 2, further characterized by a. said drive means including a rotary shaft extending through said furnace wall and connected to said lever; and b. said rotary shaft passing through a sealed passage in said furnace wall.

5. The apparatus of claim 2, further characterized by a. each of said non-fixed universal connections being Cardan joints.

6. The apparatus of claim 1, further characterized by a. said linkage means including a flexible element; and b. the connecting ends of said flexible element providing said non-fixed universal connection.

7. The apparatus of claim 6, further characterized by a. lever means connected to said drive means; and b. a cam disc on said lever means for engaging said flexible element.

8. The apparatus of claim 1, further characterized by a. said drive means including longitudinally movable shaft means extending through said furnace wall; and b. said shaft means extending through a sealed passage in said furnace wall.

9. The apparatus of claim 8, further characterized by a. said linkage means including a toggle lever connecting said non-fixed universal connections at said drive means and said distributor pipe.

10. The apparatus of claim 1, further characterized by a. said first and second horizontal axes being in the same horizontal plane.

11. The apparatus of claim 2, further characterized by a. said lever means being the same length as the distance between the said non-fixed universal connection on said distributor pipe and said second pivot axis.

* * * * *